US010176912B2

(12) United States Patent
Nishimura et al.

(10) Patent No.: US 10,176,912 B2
(45) **Date of Patent: *Jan. 8, 2019**

(54) MAGNETIC CORE, COIL COMPONENT AND MAGNETIC CORE MANUFACTURING METHOD

(71) Applicant: HITACHI METALS, LTD., Tokyo (JP)

(72) Inventors: Kazunori Nishimura, Mishima-gun (JP); Toshio Mihara, Mishima-gun (JP); Shin Noguchi, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/124,584

(22) PCT Filed: Mar. 10, 2015

(86) PCT No.: PCT/JP2015/056934

§ 371 (c)(1),
(2) Date: Sep. 8, 2016

(87) PCT Pub. No.: WO2015/137303

PCT Pub. Date: Sep. 17, 2015

(65) Prior Publication Data

US 2017/0018343 A1 Jan. 19, 2017

(30) Foreign Application Priority Data

Mar. 10, 2014 (JP) ..... 2014-046525

(51) Int. Cl.
*H01F 1/147* (2006.01)
*C22C 38/00* (2006.01)
(Continued)

(52) U.S. Cl.
CPC ..... *H01F 1/14791* (2013.01); *B22F 1/0059* (2013.01); *B22F 3/02* (2013.01);
(Continued)

(58) Field of Classification Search
None
See application file for complete search history.

(56) References Cited

U.S. PATENT DOCUMENTS 6,574,117 B1 6/2003 Lebo
6,741,466 B1 5/2004 Lebo
(Continued)

FOREIGN PATENT DOCUMENTS

JP 2-97646 A 4/1990
JP 2002-305108 A 10/2002
(Continued)

OTHER PUBLICATIONS

International Preliminary Report on Patentability with translation of Written Opinion dated Sep. 22, 2016, issued by the International Bureau in corresponding International Application No. PCT/JP2015/056934.

(Continued)

*Primary Examiner* — Kevin M Bernatz
(74) *Attorney, Agent, or Firm* — Sughrue Mion, PLLC

(57) ABSTRACT

A magnetic core has a structure in which alloy phases 20 each including Fe, Al, Cr and Si are dispersed and any adjacent two of the alloy phases 20 are connected to each other through a grain boundary phase 30. In this grain boundary phase 30, an oxide region is produced which includes Fe, Al, Cr and Si, and includes Al in a larger proportion by mass than the alloy phases 20. This magnetic core includes Al in a proportion of 3 to 10% both inclusive by mass, Cr in a proportion of 3 to 10% both inclusive by mass, and Si in a proportion more than 1% and 4% or less
(Continued)

by mass provided that the sum of the quantities of Fe, Al, Cr and Si is regarded as being 100% by mass; and includes Fe and inevitable impurities as the balance of the core.

6 Claims, 13 Drawing Sheets

(51) Int. Cl.

| | |
|---|---|
| ***H01F 1/24*** | (2006.01) |
| ***H01F 3/08*** | (2006.01) |
| ***H01F 41/02*** | (2006.01) |
| ***H01F 1/33*** | (2006.01) |
| ***C22C 38/02*** | (2006.01) |
| ***C22C 38/06*** | (2006.01) |
| ***C22C 38/18*** | (2006.01) |
| ***C22C 33/02*** | (2006.01) |
| ***B22F 1/00*** | (2006.01) |
| ***B22F 3/02*** | (2006.01) |
| ***B22F 3/24*** | (2006.01) |
| ***C21D 8/12*** | (2006.01) |
| ***C21D 9/40*** | (2006.01) |
| ***C22C 38/34*** | (2006.01) |
| ***H01F 1/22*** | (2006.01) |
| ***H01F 27/255*** | (2006.01) |
| *H01F 1/26* | (2006.01) |
| *C21D 6/00* | (2006.01) |
| *C21D 1/26* | (2006.01) |

(52) U.S. Cl.

CPC ..... *B22F 3/24* (2013.01); *C21D 8/1216* (2013.01); *C21D 9/40* (2013.01); *C22C 33/0257* (2013.01); *C22C 38/00* (2013.01); *C22C 38/002* (2013.01); *C22C 38/02* (2013.01); *C22C 38/06* (2013.01); *C22C 38/18* (2013.01); *C22C 38/34* (2013.01); *H01F 1/22* (2013.01); *H01F 1/24* (2013.01); *H01F 1/33* (2013.01); *H01F 3/08* (2013.01); *H01F 27/255* (2013.01); *H01F 41/0246* (2013.01); *B22F 2003/248* (2013.01); *B22F 2201/03* (2013.01); *B22F 2302/45* (2013.01); *B22F 2998/10* (2013.01); *C21D 1/26* (2013.01); *C21D 6/002* (2013.01); *H01F 1/26* (2013.01)

(56) References Cited

U.S. PATENT DOCUMENTS

| | | | | |
|---|---|---|---|---|
| 6,975,511 | B1 | 12/2005 | Lebo et al. | |
| 7,643,309 | B1 | 1/2010 | Lebo | |
| 8,289,222 | B2 * | 10/2012 | Suetsuna | H01F 1/33 343/787 |
| 8,896,405 | B2 * | 11/2014 | Hachiya | H01F 1/40 336/200 |
| 9,007,159 | B2 * | 4/2015 | Hachiya | H01F 5/003 336/200 |
| 9,318,809 | B2 * | 4/2016 | Takahashi | H01Q 17/004 |
| 9,805,855 | B2 * | 10/2017 | Noguchi | C22C 33/0264 |
| 2002/0097124 | A1 * | 7/2002 | Inoue | H01F 1/24 336/83 |
| 2004/0052368 | A1 | 3/2004 | Spring et al. | |
| 2005/0133116 | A1 * | 6/2005 | Nishijima | H01F 1/33 148/105 |
| 2008/0220231 | A1 * | 9/2008 | Suetsuna | B22F 1/02 428/216 |
| 2011/0267167 | A1 | 11/2011 | Ogawa et al. | |
| 2012/0038449 | A1 * | 2/2012 | Ogawa | H01F 1/33 336/221 |
| 2012/0274437 | A1 * | 11/2012 | Matsuura | H01F 1/14783 336/221 |
| 2012/0274438 | A1 * | 11/2012 | Hachiya | H01F 17/0013 336/221 |
| 2013/0154784 | A1 | 6/2013 | Hachiya et al. | |
| 2013/0200970 | A1 | 8/2013 | Ogawa et al. | |
| 2013/0228716 | A1 * | 9/2013 | Suetsuna | B22F 1/02 252/62.55 |
| 2014/0049348 | A1 | 2/2014 | Matsuura et al. | |
| 2014/0132383 | A1 | 5/2014 | Matsuura et al. | |
| 2015/0118407 | A1 * | 4/2015 | Hosek | H01F 1/24 427/456 |
| 2015/0332850 | A1 * | 11/2015 | Nishio | H01F 1/24 336/221 |
| 2016/0254082 | A1 * | 9/2016 | Tanada | C22C 38/34 420/78 |
| 2016/0336104 | A1 * | 11/2016 | Noguchi | C22C 33/0264 |
| 2017/0025214 | A1 * | 1/2017 | Nishimura | C22C 33/0257 |

FOREIGN PATENT DOCUMENTS

| | | | | |
|---|---|---|---|---|
| JP | 2005-220438 | A | 8/2005 | |
| JP | 2009-88496 | A | 4/2009 | |
| JP | 2009-88502 | A | 4/2009 | |
| JP | 2009088502 | A * | 4/2009 | |
| JP | 2011-249774 | A | 12/2011 | |
| WO | 2012/147224 | A1 | 11/2012 | |
| WO | WO-2014112483 | A1 * | 7/2014 | H01F 1/24 |

OTHER PUBLICATIONS

International Search Report for PCT/JP2015/056934 dated May 26, 2015.

Extended European Search Report dated Oct. 20, 2017, issued by the European Patent Office in counterpart application No. 15761100.5.

Communication dated Feb. 8, 2018 issued by the State Intellectual Property Office of the People's Republic of China in counterpart Chinese Application No. 201580012653.4.

Communication dated Aug. 23, 2018, from the Japanese Patent Office in application No. 2016-507851.

* cited by examiner (a)

Electron microscope image 1

(b)

Iron Kα1

(c)

Aluminum Kα1

(d)

Chromium Kα1

(e)

Silicon Kα1

(f)

Oxygen Kα1

(a)

Electron microscope image 1

(b)

Iron Kal (c)

Aluminum Kal (d)

Chromium Kal (e)

Silicon Kal (f)

Oxygen Kal (a)

(b)

Iron Kal (c)

Aluminum Kal (d)

Chromium Kal (e)

Silicon Kal (f)

Oxygen Kal (a)

Electron microscope image 1

(b)

Iron Kal (c)

Aluminum Kal (d)

Chromium Kal (e)

Silicon Kal (f)

Oxygen Kal (a)

Electron microscope image 1

(b)

Iron Kal (c)

Aluminum Kal (d)

Chromium Kal (e)

Silicon Kal (f)

Oxygen Kal (a)

Electron microscope image 1

(b)

Iron Kal (c)

Aluminum Kal (d)

Chromium Kal (e)

Silicon Kal (f)

Oxygen Kal

MAGNETIC CORE, COIL COMPONENT AND MAGNETIC CORE MANUFACTURING METHOD

CROSS REFERENCE TO RELATED APPLICATIONS

This application is a National Stage of International Application No. PCT/ JP2015/056934filed Mar. 10, 2015 (claiming priority based on Japanese Patent Application No. 2014-046525filed Mar. 10, 2014), the contents of which are incorporated herein by reference in their entirety.

TECHNICAL FIELD

The present invention relates to a magnetic core having a structure in which alloy phases are dispersed, a coil component using this magnetic core, and a method for manufacturing the magnetic core.

BACKGROUND ART

Hitherto, coil components such as an inductor, a transformer, and a choke coil, have been used in various articles such as household electric appliances, industrial equipment, and vehicles. A coil component includes a magnetic core and a coil fitted to the magnetic core. As this magnetic core, a ferrite magnetic core, which is excellent in magnetic property, shape flexibility and costs, has widely been used.

In recent years, a decrease in the size of power source devices of electronic instruments and others has been advancing, so that intense desires have been increased for coil components which are small in size and height, and are usable against a large current. As a result, the adoption of powder magnetic cores, in each of which a metallic magnetic powder is used, and which are higher in saturation magnetic flux density than the ferrite magnetic core, has been advancing. As metallic magnetic powders, for example, pure Fe particles, and Fe-based magnetic alloy particles such as those of Fe—Si-based, Fe—Al—Si-based and Fe—Cr—Si-based alloys are used.

The saturation magnetic flux density of any Fe-based soft magnetic alloy is, for example, 1 T or more. A magnetic core using this alloy has excellent DC superimposition characteristics even when made small in size. In the meantime, the magnetic core is small in specific resistance and large in eddy current loss since the core contains a large quantity of Fe. Thus, it has been considered that unless grains of the alloy are coated with an insulator such as resin or glass, it is difficult to use the magnetic core for any article for which a higher frequency than 100 kHz is required. However, such a magnetic core, in which Fe-based soft magnetic alloy grains are bonded to each other to interpose an insulator therebetween, is large in magnetic core loss. Thus, a decrease in the loss has been desired. Moreover, the magnetic core may be poorer in strength than ferrite magnetic cores by an effect of the insulator.

Patent Document 1 discloses a magnetic core obtained by using a soft magnetic alloy having a composition of Cr: 2 to 8 wt %, Si: 1.5 to 7 wt % and Fe: 88 to 96.5 wt %, or Al: 2 to 8 wt %, Si: 1.5 to 12 wt % and Fe: 80 to 96.5 wt %, and heat-treating a compact made of grains of the soft magnetic alloy in an atmosphere containing oxygen.

Patent Document 2 discloses a magnetic core obtained by: applying a heat treatment at 800° C. or higher in an oxidizing atmosphere to an Fe—Cr—Al based magnetic powder including Cr: 1.0 to 30.0% by mass and Al: 1.0 to 8.0% by mass and including the balance of the core consisting substantially of Fe, thereby self-producing an aluminum-including oxidized coat film on the surface of the powder; and further solidifying and compacting the magnetic powder by discharge-plasma sintering in a vacuum chamber. This Fe—Cr—Al based magnetic powder may contain, as an impurity, Si: 0.5% or less by mass.

PRIOR ART DOCUMENTS

Patent Documents

Patent Document 1: JP-A-2011-249774
Patent Document 2: JP-A-2005-220438

SUMMARY OF THE INVENTION

Problems to be Solved by the Invention

However, about the magnetic cores described in Patent Documents 1 and 2, a decrease in the magnetic core loss thereof is not considered, and further both of specific resistance and strength are not sufficiently ensured. In light of the actual situation, the present invention has been made. An object thereof is to provide a magnetic core which is excellent against magnetic core loss and ensures specific resistance and strength, a coil component using this magnetic core, and a method for manufacturing the magnetic core.

Means for Solving the Problems

The object can be achieved by the following present invention. The present invention provides a magnetic core, having a structure in which alloy phases each including Fe, Al, Cr and Si are dispersed and any adjacent two of the alloy phases are connected to each other through a grain boundary phase, and having a composition which includes Al in a proportion of 3 to 10% both inclusive by mass, Cr in a proportion of 3 to 10% both inclusive by mass, and Si in a proportion more than 1% and 4% or less by mass provided that the sum of the quantities of Fe, Al, Cr and Si is regarded as being 100% by mass, and which includes Fe and inevitable impurities as the balance of the core, wherein the grain boundary phase comprises an oxide region including Fe, Al, Cr and Si, and includes Al in a larger proportion by mass than the alloy phases.

In the magnetic core in accordance with the present invention, it is preferable to include Si in a proportion of 3% or less by mass. In the magnetic core in accordance with the present invention, it is preferable to have a specific resistance of $0.5\times10^3$ Ω·m or more, and a radial crushing strength of 120 MPa or more. Respective values of the specific resistance and the radial crushing strength are specifically values obtained by measuring methods in the item EXAMPLES, which will be described later.

A coil component in accordance with the present invention, comprise the magnetic core described above and a coil fitted to the magnetic core.

A magnetic core manufacturing method in accordance with the present invention, comprise the steps of: mixing a binder with Fe-based soft magnetic alloy grains which include Al in a proportion of 3 to 10% both inclusive by mass, Cr in a proportion of 3 to 10% both inclusive by mass, and Si in a proportion more than 1% and 4% or less by mass, and which includes Fe and inevitable impurities as the balance of the grains to yield a mixed powder; subjecting the mixed powder to pressing to yield a compact; and subjecting the compact to heat treatment in an atmosphere including oxygen to yield a magnetic core having a structure in which alloy phases comprising the Fe-based soft magnetic alloy grains are dispersed; wherein the heat treatment results in: forming a grain boundary phase through which the alloy phases are connected to each other; and further producing, in the grain boundary phase, an oxide region including Fe, Al, Cr and Si and further including Al in a larger proportion by mass than the alloy phases.

EFFECT OF THE INVENTION

The present invention makes it possible to provide a magnetic core which is excellent against magnetic core loss and ensures specific resistance and strength, a coil component using this magnetic core, and a method for manufacturing the magnetic core.

MODE FOR CARRYING OUT THE INVENTION

Hereinafter, embodiments of the present invention will be specifically described. However, the invention is not limited to these embodiments.

Figure 1:
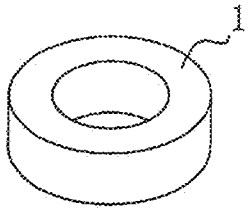
FIG. 1 is an external view illustrating an example of the magnetic core according to the present invention.
Figure 2:
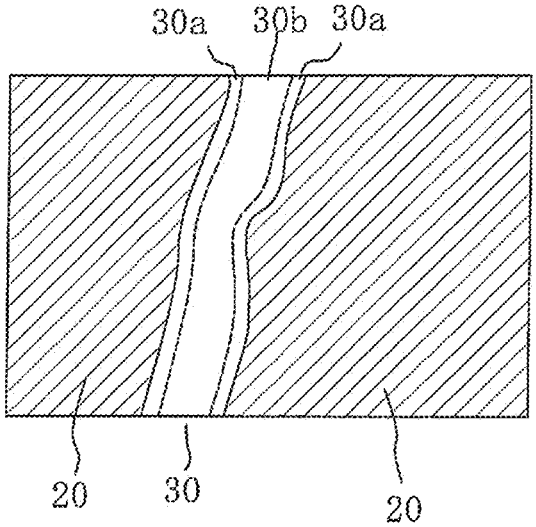
FIG. 2 is a schematic view showing an example of a structure of the magnetic core.

A magnetic core 1 illustrated in FIG. 1 has a structure in which alloy phases each including Fe (iron), Al (aluminum), Cr (chromium) and Si (silicon) are dispersed. The alloy phases are made of Fe-based soft magnetic alloy grains including Al, Cr and Si, and including Fe and inevitable impurities as the balance thereof. FIG. 2 is an example of the structure, and adjacent alloy phases 20 are connected to each other through a grain boundary phase 30. In this grain boundary phase 30, an oxide region is produced which includes Fe, Al, Cr and Si, and includes Al in a larger proportion by mass than the alloy phases 20. This magnetic core 1 includes Al in a proportion of 3 to 10% both inclusive by mass, Cr in a proportion of 3 to 10% both inclusive by mass, and Si in a proportion more than 1% and 4% or less by mass provided that the sum of the quantities of Fe, Al, Cr and Si is regarded as being 100% by mass; and further includes Fe and inevitable impurities as the balance of the core 1.

The non-ferrous metals (that is, Al, Cr and Si) included in the Fe-based soft magnetic alloy grains are each larger in affinity with O (oxygen) than Fe. Thus, when the Fe-based soft magnetic alloy is heat-treated in an atmosphere containing oxygen, oxides of these non-ferrous metals with Fe are produced, and then the surface of the Fe-based soft magnetic alloy grains is coated with the oxides. In this way, the oxide region in the grain boundary phase 30 is a region obtained by subjecting a compact including the Fe-based soft magnetic alloy grains to heat treatment in an oxidizing atmosphere, thereby causing the Fe-based soft magnetic alloy grains to react with oxygen to be grown. Thus, this region is formed by an oxidizing reaction exceeding natural oxidization of the Fe-based soft magnetic alloy grains. Fe and the respective oxides of the non-ferrous metals have a higher electrical resistance than a simple substance of each of the metals, so that the grain boundary phase 30 intervening between the alloy phases 20 functions as an insulating layer.

The heat treatment in the oxidizing atmosphere can be conducted in an atmosphere in which oxygen is present, such as the air atmosphere, or a mixed gas of oxygen and an inert gas. The heat treatment may be conducted in an atmosphere in which water vapor is present, such as a mixed gas of water vapor and an inert gas. Out of such treatments, heat treatment in the air atmosphere is simple to be preferred. The pressure of the heat treatment atmosphere is not particularly limited, and is preferably the atmospheric pressure since no control of the pressure is necessary.

The Fe-based soft magnetic alloy grains used for forming the alloy phases 20 include, as a main component highest in content by percentage, Fe among the constituting components of the grains. The grains include, as secondary components thereof, Al, Cr and Si. Fe is a main element for constituting the Fe-based soft magnetic alloy grains, and affects the saturation magnetic flux density and other magnetic properties thereof, as well as the strength and other mechanical properties thereof. The Fe-based soft magnetic alloy grains contain Fe preferably in a proportion of 80% or more by mass, this proportion being dependent on the balance between Fe and the other non-ferrous metals. This case makes it possible to yield a soft magnetic alloy high in saturation magnetic flux density.

Al is larger in affinity with O than Fe and other non-ferrous metals. Thus, when the Fe-based soft magnetic alloy is heat-treated, O in the air atmosphere or O in the binder is preferentially bonded to Al near the surface of the Fe-based soft magnetic alloy grains to produce $Al_2O_3$, which is chemically stable, and multiple oxides of the other non-ferrous metals with Al on the surface of the alloy phases 20. Moreover, O which is to invade the alloy phases 20 reacts with Al so that Al-including oxides are produced one after another. Consequently, the invasion of O into the alloy phases 20 is prevented to restrain an increase in the concentration of O, which is an impurity, so that the resultant can be prevented from being deteriorated in magnetic properties. The Al-including oxide region excellent in corrosion resistance property and stability is produced on the surface of the alloy phases 20. This production makes it possible to heighten the insulating property between the alloy phases 20, so that the magnetic core can be improved in specific resistance and eddy current loss can be decreased.

The Fe-based soft magnetic alloy grains include Al in a proportion of 3 to 10% both inclusive by mass. If this proportion is less than 3% by mass, Al-including oxides may not be sufficiently produced to lower the oxide region in insulating property and corrosion resistance property. The Al content is preferably 3.5% or more by mass, more preferably 4.0% or more by mass, even preferably 4.5% or more by mass. In the meantime, if the proportion is more than 10% by mass, the quantity of Fe is decreased so that the resultant magnetic core may be deteriorated in magnetic properties, for example, the core may be lowered in saturation magnetic flux density and initial permeability and be increased in coercive force. The Al content is preferably 8.0% or less by mass, more preferably 7.0 or less by mass, even more preferably 6.0% or less by mass, particularly preferably 5.0% or less by mass.

Cr is largest in affinity with O next to Al. In the heat treatment, Cr is bonded to O in the same manner Al to produce $Cr_2O_3$, which is chemically stable, and multiple oxides of the other non-ferrous metals with Cr. In the meantime, Cr in the produced oxides easily becomes smaller in quantity than Al since the Al-including oxides are preferentially produced. The Cr-including oxides are excellent in corrosion resistance property and stability to enhance the insulating property between the alloy phases 20, so that the resultant magnetic core can be decreased in eddy current loss.

The Fe-based soft magnetic alloy grains include Cr in a proportion of 3 to 10% both inclusive by mass. If this proportion is less than 3% by mass, Cr-including oxides may not be sufficiently produced so that the oxide region may be lowered in insulating property and corrosion resistance property. The Cr content is preferably 3.5% or more by mass, more preferably 3.8% or more by mass. In the meantime, if this proportion is more than 10% by mass, the quantity of Fe is decreased so that the magnetic core may be deteriorated in magnetic properties, for example, the core may be lowered in saturation magnetic flux density and initial permeability and be increased in coercive force. The Cr content is preferably 9.0% or less by mass, more preferably 7.0% or less by mass, even more preferably 5.0% or less by mass.

In order to heighten the insulating property and corrosion resistance property, the total content of Al and Cr is preferably 7% or more by mass, more preferably 8% or more by mass. In order to restrain the change rate of the magnetic core loss which depends on the heat treatment temperature to ensure a wide control scope of the heat treatment temperature, the total content of Cr and Al is more preferably 11% or more by mass. Moreover, Al becomes remarkably larger in concentration than Cr in the oxide region between the alloy phases 20; thus, it is more preferred to use Fe-based soft magnetic alloy grains in which Al is larger in content by percentage than Cr.

In the same manner as Al or Cr, Si is bonded to O to produce $SiO_2$, which is chemically stable, and multiple oxides of the other non-ferrous metals with Si. The Si-including oxides are excellent in corrosion resistance property and stability to heighten the insulating property between the alloy phases 20, so that the magnetic core can be decreased in eddy current loss. Although Si has effects of improving the magnetic permeability of the magnetic core and lowering the magnetic loss thereof, an excessively large content by percentage of Si makes the alloy grains hard to deteriorate the grains in fillability into a die. Thus, a compact obtained therefrom by pressing tends to be decreased in density to be lowered in magnetic permeability and be increased in magnetic loss.

The Fe-based soft magnetic alloy grains include Si in a proportion more than 1% and 4% or less by mass. The specific resistance and the strength of the magnetic core are lowered by an increase in the proportion of the quantity of Si. However, the magnetic core ensures these properties at a sufficiently high level as far as the proportion is 4% or less by mass. The magnetic core can gain, for example, a specific resistance more than $0.5\times10^3$ Ω·m, and a radial crushing strength of 120 MPa or more. Furthermore, when the proportion of Si is more than 1% and 3% or less by mass, the magnetic core can gain a low magnetic core loss and a high initial permeability, for example, an initial permeability of 50 or more.

The Fe-based soft magnetic alloy grains may contain C (carbon), Mn (manganese), P (phosphorus), S (sulfur), O (oxygen), Ni (nickel), N (nitrogen) and others as inevitable impurities. The content of each of these inevitable impurities is preferably as follows: C≤0.05% by mass; Mn≤1% by mass; P≤0.02% by mass; S≤0.02% by mass; O≤0.5% by mass; Ni≤0.5% by mass; and N≤0.1% by mass.

As has been already described, the structure which the magnetic core has includes alloy phases and a grain boundary phase. The grain boundary phase is formed by oxidizing the Fe-based soft magnetic alloy grains according to the heat treatment. Accordingly, the composition of the alloy phases is different from that of the Fe-based soft magnetic alloy grains. However, e.g., the evaporation and scattering of Fe, Al, Cr and Si on the basis of the heat treatment do not easily cause a shift or deviation of the composition, so that in any region including the alloy phases and the grain boundary phase, the composition of the magnetic core from which O is excluded becomes substantially equal in composition to the Fe-based soft magnetic alloy grains. Such a magnetic core composition can be quantitatively determined by analyzing a cross section of the magnetic core by an analyzing method such as scanning electron microscopy with energy dispersive X-ray spectroscopy (SEM/EDX).

The grain boundary phase 30 is made substantially of oxides. The Fe-based soft magnetic alloy grains are bonded to each other to interpose the grain boundary phase 30 therebetween, so that the magnetic core can gain an excellent specific resistance and strength. The grain boundary phase 30 has, for example, a first region **30*a* and a second region 30*b* as illustrated in FIG. 2, and the first region 30*a* is formed at an alloy-phase-20-side. The first region 30*a* is a region in which the ratio of the quantity of Al to the sum of the quantities of Fe, Al, Cr and Si is higher than that of the quantity of each of Fe, Cr and Si thereto. The second region 30*b* is a region in which the ratio of the quantity of Fe to the sum of the quantities of Fe, Al, Cr and Si is higher than that of the quantity of each of Al, Cr and Si thereto. In short, the grain boundary phase 30 has the first region 30*a*, in which Al is more largely concentrated than Fe, Cr and Si, and the second region 30***b*, in which Fe is more largely concentrated than Al, Cr and Si.

In the example in FIG. 2, in the grain boundary phase 30, the first region 30*a* is formed at an interface side of the grain boundary phase 30, this interface being between the phase 30 and the alloy phases 20, and the second region 30*b* is formed at an inner side of the grain boundary phase 30. The first region 30*a* extends along the interface between the alloy phases 20 and the grain boundary phase 30 to contact this interface. In the meantime, the second region 30*b* is sandwiched, from both sides thereof, between portions of the first region 30*a*, and is apart from the interface between the alloy phases 20 and the grain boundary phase 30 not to contact this interface. It is preferred that in this way, the first region 30*a* is formed in edge parts in the thickness direction of the grain boundary phase 30, and the second region 30*b* is formed in a central part in the thickness direction of the grain boundary phase 30. It is preferred that the alloy phases 20 are in the form of grains and further the alloy phases do not directly contact each other to be each independent in the state that the grain boundary phase is interposed therebetween.

The coil component according to the present invention has a magnetic core as described above, and a coil fitted to the magnetic core, and is used as, e.g., a choke, an inductor, a reactor, or a transformer. Electrodes to which ends of the coil are to be connected may be formed on the surface of the magnetic core by, e.g., a plating or baking method. The coil may be formed by winding a conductive line directly onto the magnetic core, or winding a conductive line onto a bobbin made of heat resistance resin. The coil is wound onto the circumference of the magnetic core, or arranged inside the magnetic core. In the latter case, a coil component may be formed which has a magnetic core having a coil sealed-in structure in which the coil is arranged to be sandwiched between a pair of magnetic cores.

Figure 3:
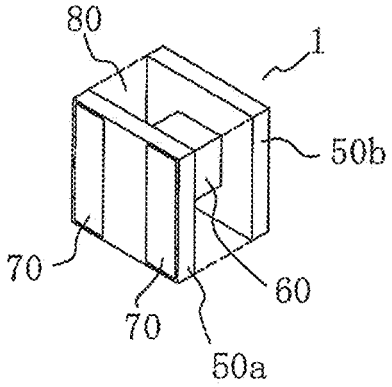
FIG. 3 is an external view illustrating an example of a coil component according to the present invention.

A coil component illustrated in FIG. 3 has a rectangular-flange-form magnetic core 1 having a body 60 between a pair of flanges 50*a* and 50*b* to be integrated with the flanges. Two terminal electrodes 70 are formed on a surface of one 50*a* of the two flanges. The terminal electrodes 70 are formed by printing and baking a silver conductor paste directly onto the surface of the magnetic core 1. A coil made of a wound line 80 that is an enamel conductive line is arranged around the body 60, an illustration of this situation being omitted. Both ends of the wound line 80 are connected to the terminal electrodes 70, respectively, by thermo-compression bonding, so that a surface-mount-type coil component such as a choke coil is formed. In the present embodiment, the flange surface on which the terminal electrodes 70 are formed is rendered a surface to be mounted onto a circuit board.

A high specific resistance which the magnetic core 1 has permits a conductive line to lay directly onto the magnetic core 1 even when a resin case (referred to also as a bobbin) for electrical insulation is not used. Furthermore, when this specific resistance is, for example, $0.5\times10^3$ Ω·m or more, preferably $1\times10^3$ Ω·m or more, the terminal electrodes 70, to which a winding line is connected, can be formed on the surface of the magnetic core to make the coil component small in size. Moreover, it is possible to lower the coil component in mount-height and give a stable mountability. Additionally, a high strength which the magnetic core 1 has, for example, a radial crushing strength thereof that is 120 MPa or more does not cause an easy breakdown of the coil component even by applying the effect of an external force onto the flanges 50*a* and 50*b* or the body 60 at the time of winding the conductive line onto the circumference of the body 60. Thus, the coil component is excellent for practicability.

The method for manufacturing this magnetic core in accordance with the present invention, includes the step of mixing a binder with Fe-based soft magnetic alloy grains to yield a mixed powder (first step); the step of subjecting the mixed powder to pressing to yield a compact (second step) ; and the step of subjecting the compact to heat treatment in an atmosphere including oxygen to yield a magnetic core having a structure in which alloy phases including the Fe-based soft magnetic alloy grain are dispersed (third step). By this heat treatment, the grain boundary phase 30 is formed, through which any adjacent two of the alloy phases 20 are connected to each other, as shown in FIG. 2. Simultaneously, in the grain boundary phase 30, an oxide region is produced which includes Fe, Al, Cr and Si, and further includes Al in a larger proportion by mass than the alloy phase 20.

In the first step, Fe-based soft magnetic alloy grains are used which include Al in a proportion of 3 to 10% both inclusive by mass, Cr in a proportion of 3 to 10% both inclusive by mass and Si in a proportion more than 1% and 4% or less by mass and which include Fe and inevitable impurities as the balance of the grains. A more preferred composition and others of the Fe-based soft magnetic alloy grains are as described above. Thus, any overlapped description thereabout is omitted.

The Fe-based soft magnetic alloy grains preferably have an average grain diameter of 1 to 100 μm as a median diameter d50 in a cumulative grain size distribution thereof. When the grains have such a small grain diameter, the magnetic core can be improved in strength, and is decreased in eddy current loss to be improved in magnetic core loss. In order to improve the magnetic core in strength, magnetic core loss and high-frequency property, the median diameter d50 is more preferably 30 μm or less, even more preferably 20 μm or less. In the meantime, if the grain diameter is too small, the magnetic core is easily lowered in magnetic permeability. Thus, the median diameter d50 is preferably 5 μm or more.

For the production of the Fe-based soft magnetic alloy grains, it is preferred to use an atomizing method (such as a water atomizing or gas atomizing method), which is suitable for producing substantially spherical alloy grains, which are high in malleability and ductility not to be easily crushed. Particularly preferred is a water atomizing method, by which fine alloy grains can be efficiently produced. The water atomizing method makes it possible to melt a crude raw material weighed to give a predetermined alloy composition in a high frequency heating furnace, or melt an alloy ingot produced beforehand into an alloy composition in a high frequency heating furnace, and then cause the hot melt (melted metal) to collide with water sprayed at a high speed and a high pressure, thereby making the metal into fine grains and simultaneously cooling the metal to yield the Fe-based soft magnetic alloy grains.

On the surface of the alloy grains obtained by the water atomizing method (water atomized powder), a naturally oxidized coat film including $Al_2O_3$, which is an oxide of Al, maybe formed into an island form or a membrane form with a thickness of about 5 to 20 nm. The island form referred to herein denotes a state that the oxide of Al is scattered into the form of dots on the surface of the alloy grains. The naturally oxidized coat film may contain any oxide of Fe.

When the naturally oxidized coat film is formed on the surface of the alloy grains, the grains can obtain a rustpreventing effect, so that the grains can be prevented from being uselessly oxidized up to a time when the Fe-based soft magnetic alloy grains are heat-treated. Thus, the Fe-based soft magnetic alloy grains can also be stored in the air atmosphere. In the meantime, if the oxidized coat film becomes thick, the alloy grains become hard so that the grains may be damaged in formability. For example, the water atomized powder just after the water atomizing is in a wet state with water. It is therefore preferred, at the time when the powder needs to be dried, to set the drying temperature (for example, the internal temperature of a drying furnace therefor) to 150° C. or lower.

The grain diameter of the resultant Fe-based soft magnetic alloy grains has a distribution. Accordingly, when the grains are filled into a die, large gaps are formed between grains large in grain diameter, out of the grains, so that the filling factor thereof is not raised to tend to lower the density of the compact yielded by pressing. It is therefore preferred to classify the resultant Fe-based soft magnetic alloy grains to remove the grains large in grain diameter. The method for the classification may be any drying classification, such as classification with a sieve. It is preferred to yield alloy grains having at largest a grain diameter smaller than 32 μm (i.e., grains that have passed through a sieve having a sieve opening size of 32 μm).

A binder to be blended into the Fe-based soft magnetic alloy grains allows the alloy grains to be bonded to each other in the pressing, and give the compact such a strength that this compact can resist against any handling of the compact after the forming. A mixed powder of the Fe-based soft magnetic alloy grains and the binder is preferably granulated into a granule. This case makes it possible to improve the granule in fluidity and fillability inside the die. The kind of the binder is not particularly limited, and may be, for example, an organic binder such as polyethylene, polyvinyl alcohol or acrylic resin. It is allowable to use the binder together with an inorganic binder, which remains after the heat treatment. However, the grain boundary phase produced in the third step produces an effect of binding the alloy grains to each other; thus, it is preferred to omit any inorganic binder to make the process simple.

It is sufficient for the addition amount of the binder to permit the binder to spread sufficiently between the Fe-based soft magnetic alloy grains to ensure the strength of the resultant compact sufficiently. However, if the addition amount of the binder is too large, the compact tends to be lowered in density and strength. From this viewpoint, the addition amount of the binder is set into a range preferably from 0.2 to 10 parts by weight, more preferably from 0.5 to 3.0 parts by weight for 100 parts by weight of the Fe-based soft magnetic alloy grains.

The method for mixing the binder with the Fe-based soft magnetic alloy grains is not particularly limited. Thus, a mixing method or mixer known in the prior art may be used. The granulating method may be, for example, rolling granulation, or any wet granulating method such as spray drying granulation. Out of such examples, spray drying granulation using a spray drier is preferred. This method makes it possible to make the shape of the granule close to a sphere, and shorten a period when the granule is exposed to heated air to give a large quantity of the granule.

The resultant granule preferably has a bulk density of 1.5 to $2.5\times10^3$ kg/m$^3$ and an average grain diameter (d50) of 60 to 150 μm. Such a granule is excellent in fluidity when made into a shape, and further makes the gap between alloy grains thereof small to be increased in fillability into the die. As a result, the compact becomes high in bulk density to yield a magnetic core high in magnetic permeability. In order to obtain a desired granule diameter, classification with, for example, a vibrating sieve is usable.

In order to decrease the friction between the mixed powder (granule) and the die in the pressing, it is preferred to add a lubricant such as stearic acid or a stearate to the grains. The addition amount of the lubricant is set into a range preferably from 0.1 to 2.0 parts by weight for 100 parts by weight of the Fe-based soft magnetic alloy grains. The lubricant may be applied to the die.

In the second step, the mixed powder of the Fe-based soft magnetic alloy grains and the binder is preferably granulated as described above, and subjected to pressing. In the pressing, the mixed powder is formed into a predetermined shape such as a toroidal shape or a rectangular parallelepiped shape, using a press machine such as a hydraulic press machine or servo press machine, and die. This pressing may be pressing at room temperature, or hot pressing, in which the granule is heated at a temperature that does not permit the binder to be lost and that is near to the glass transition temperature of the binder, which permits the binder to be softened, in accordance with the material of the binder. The fluidity of the granule inside the die can be improved by the shape of the Fe-based soft magnetic alloy grains, the shape of the granule, the selection of the average grain diameter of the grains and/or that of the granule, and the effect of the binder and the lubricant.

In the compact yielded by the pressing, the Fe-based soft magnetic alloy grains are brought into point contact or surface contact with each other to interpose the binder or the naturally oxidized coat film therebetween. Moreover, the Si content in the Fe-based soft magnetic alloy grains is controlled into the predetermined range. The control gives the compact a sufficiently large forming-density and strength even at a low pressure of 1 GPa or less. By such a low-pressing, the following decrease can be attained: a decrease of breakages of the naturally oxidized coat film, which is formed on the surface of the Fe-based soft magnetic alloy grains and contains Al. Consequently, the corrosion resistance property of the compact is heightened. The density of the compact is preferably $5.7\times10^3$ kg/m$^3$ or more. The radial crushing strength of the compact is preferably 3 MPa or more.

In the third step, the compact is subjected to annealing as a heat treatment to gain good magnetic properties by a relief of stress strains introduced into the compact by the pressing. By this annealing, the grain boundary phase 30 is formed, though which any adjacent two of the alloy phases 20 are connected to each other, and further in the grain boundary phase 30 an oxide region is produced in which Fe, Al, Cr and Si are included and further Al is included in a larger proportion by mass than in the alloy phases 20. The organic binder is thermally discomposed and lost by the annealing. Since the oxide region is produced in this way by the heat treatment after the pressing, a magnetic core excellent in strength and others can be manufactured by a simple method without using any insulator such as glass.

The annealing is performed in an oxygen-containing atmosphere, such as the air atmosphere, or a mixed gas of oxygen and an inert gas. The heat treatment in the air atmosphere is preferred since the treatment is simple. As has been already described, the grain boundary phase 30 is obtained by reaction between the Fe-based soft magnetic alloy grains and oxygen in the heat treatment, and is produced by an oxidization reaction which exceeds natural oxidization of the Fe-based soft magnetic alloy grains. The production of the grain boundary phase 30 gives a magnetic core excellent in insulating property and corrosion resistance property, and high in strength, in which a large number of the Fe-based soft magnetic alloy grains are strongly bonded to each other.

The magnetic core, which is formed by use of Fe-based soft magnetic alloy grains as described above, is a core which includes Al in a proportion of 3 to 10% both inclusive by mass, Cr in a proportion of 3 to 10% both inclusive by mass, and Si in a proportion more than 1% and 4% or less by mass provided that the sum of the quantities of Fe, Al, Cr and Si is regarded as being 100% by mass, and which includes Fe and inevitable impurities as the balance of the core.

In the magnetic core obtained via the heat treatment, the space factor ranges preferably from 82 to 90%. This case makes it possible to heighten the space factor to improve the core in magnetic properties while loads to facilities and costs are restrained.

After the annealing, a cross section of the magnetic core is observed, using a scanning electron microscope (SEM) and the distribution of each of the constituting elements is examined by energy dispersive X-ray spectroscopy (EDX). In this case, it is observed that Al is concentrated in the grain boundary phase 30. Furthermore, when a cross section of the magnetic core is observed using a transmission electron microscope (TEM), an oxide region showing a lamellar structure as illustrated in FIG. 2 is observed.

Furthermore, when the composition of the magnetic core is analyzed in detail by EDX using a transmission electron microscope (TEM), it is observed that the grain boundary phase 30 contains Fe, Al, Cr and Si. Additionally, in the vicinity of the alloy phases 20, the ratio of the quantity of Al to the sum of the quantities of Fe, Al, Cr and Si is higher than the ratio of the quantity of each of Fe, Cr and Si thereto. This region corresponds to the "first region". In an intermediate part between the alloy phases 20, the ratio of the quantity of Fe to the sum of the quantities of Fe, Al, Cr and Si is higher than the ratio of the quantity of each of Al, Cr and Si thereto. This region corresponds to the "second region". In the grain boundary phase 30 illustrated in FIG. 2, the oxide region is in the lamellar structure; however, the form of the grain boundary phase is not limited to this form. The grain boundary phase may be, for example, in such a form that the second region is enveloped with the first region to be in an island form.

In order to relieve stress strains in the compact and produce the oxide region in the grain boundary phase 30, the annealing temperature is preferably a temperature permitting the compact to have a temperature of 600° C. or higher. The annealing temperature is also preferably a temperature permitting the compact to have a temperature of 850° C. or lower to avoid a matter that the grain boundary phase 30 is partially lost, denatured or damaged in any other manner to lower the compact in insulating property, or the compact is remarkably advancingly sintered so that the Fe-based soft magnetic alloy grains directly contact each other to increase portions where these phases are partially connected to each other (necked portions), whereby the magnetic core is lowered in specific resistance to be increased in eddy current loss. From this viewpoint, the annealing temperature is more preferably from 650 to 830° C., even more preferably from 700 to 800° C. The period when the compact is kept at this annealing temperature is appropriately set in accordance with the size of the magnetic core, the treating quantity of such magnetic cores, a range in which a variation in properties thereof is permitted, and others. The period is set, for example, into a range of 0.5 to 3 hours. The necked portions are permitted to be partially formed unless an especial hindrance is given to the specific resistance or magnetic core loss.

If the thickness of the grain boundary phase 30 is too large, the interval between the alloy phases is widened to make the magnetic core low in magnetic permeability and large in hysteresis loss, and the proportion of the oxide region containing nonmagnetic oxides may be increased to make the magnetic core low in saturation magnetic flux density. Thus, the average thickness of the grain boundary phase 30 is preferably 100 nm or less, more preferably 80 nm or less. In the meantime, if the thickness of the grain boundary phase 30 is too small, a tunnel current flowing into the grain boundary phase 30 may increase an eddy current loss. Thus, the average thickness of the grain boundary phase 30 is preferably 10 nm or more, more preferably 30 nm or more. The average thickness of the grain boundary phase 30 is calculated out by: observing a cross section of the magnetic core through a transmission electron microscope (TEM) at a magnifying power of 600,000 or more; measuring, in a region where the contour of alloy phases is identified inside the observed vision field, the thickness of a portion where the alloy phases 20 are made closest to each other (minimum thickness), and that of a portion where the alloy phases are made farthest from each other (maximum thickness); and then making the arithmetic average of the two.

In order to improve the strength and high-frequency properties of the magnetic core, the average of the respective maximum diameters of the Fe-based soft magnetic alloy grains constituting the alloy phases 20 is preferably 15 μm or less, more preferably 8 μm or less. In the meantime, to restrain the magnetic permeability from being lowered, the average of the respective maximum diameters of the Fe-based soft magnetic alloy grains is preferably 0.5 μm or more. The average of the maximum diameters is calculated out by polishing a cross section of the magnetic core, observing the section through a microscope, reading out the respective maximum diameters of 30 or more out of grains presenting inside the vision field having a predetermined area, and then calculating the number-average diameter thereof. The Fe-based soft magnetic alloy grains after the pressing are plastically deformed; according to the cross section observation, almost all of the alloy phases are each naked in a cross section of a part of the alloy phase that is different from a central part of this phase, so that the above-mentioned average of the maximum diameters is a value smaller than the median diameter d50 estimated when the grains are in the powder state.

In order to improve the magnetic core in strength and high frequency properties, it is preferred in an observation image of a cross section of the magnetic core through SEM at a magnifying power of 1,000 that the abundance ratio of Fe-based soft magnetic alloy grains having a maximum diameter of 40 μm or more is 1% or less. This abundance ratio is a value obtained by measuring the number K1 of all alloy grains, each of which are surrounded by the grain boundary phase 30, inside the observed vision field with at least 0.04 $mm^2$ or more, and the number K2 of alloy grains having a maximum diameter of 40 μm or more, out of these phases; dividing K2/k1, and representing the resultant value in the unit of percent. The measurement of K1 and k2 are made under a condition that alloy grains having a maximum diameter of 1 μm or more are targets. The magnetic core is improved in frequency properties by making the Fe-based soft magnetic alloy grains fine, these grains constituting this core.

EXAMPLES

Working examples of the present invention will be specifically described. In Table 1, about alloy grains obtained by producing, through a water atomizing method, each of seven Fe-based soft magnetic alloy grain species different from each other in Si content by percentage, and then passing the produced grain species through a 440-mesh (sieve opening size: 32 μm) sieve to remove coarse grains, measured results of the composition analysis and the average grain diameter (median diameter d50) thereof are shown. The proportion of Al is an analytic value obtained by ICP emission spectroscopy; the proportion of Cr is an analytic value obtained by a capacitance method; and the proportion of Si is an analytic value obtained by absorption photometry. The average grain diameter is a value measured by a laser diffraction scattering grain-size-distribution measuring device (LA-920, manufactured by Horiba Ltd.). These Fe-based soft magnetic alloy grain species were each used to manufacture a magnetic core through steps (1) to (3) described below. The resultant magnetic cores were called Comparative Examples 1 and 2, Reference Example 1 and 2, and Working Examples 1 to 3, respectively.

TABLE 1

| Alloy grains | Al (% by mass) | Cr (% by mass) | Si (% by mass) | Fe | d50 (μm) |
|---|---|---|---|---|---|
| No. 1 | 4.92 | 3.94 | 0.11 | bal. | 13.8 |
| No. 2 | 4.92 | 3.89 | 0.2 | bal. | 9.8 |
| No. 3 | 4.93 | 3.89 | 0.53 | bal. | 12.3 |
| No. 4 | 4.87 | 4.04 | 0.94 | bal. | 12.4 |
| No. 5 | 4.85 | 3.9 | 1.92 | bal. | 14.7 |
| No. 6 | 4.76 | 3.81 | 2.87 | bal. | 11.6 |
| No. 7 | 4.81 | 3.80 | 3.82 | bal. | 10.5 |

(1) Mixing

An agitating crusher was used to add, to 100 parts by weight of each of the Fe-based soft magnetic alloy grain species, 2.5 parts by weight of a PVA (POVAL PVA-205, manufactured by Kuraray Co., Ltd.; solid content: 10%) as a binder, and then mix these components. The resultant mixture was dried at 120° C. for 10 hours, and then passed through a sieve to yield a granule of the mixed powder. The average grain diameter (d50) thereof was set into the range of 60 to 80 μm. Moreover, 0.4 part by weight of zinc stearate was added to 100 parts by weight of the granule. A container-rotating/vibrating type powder mixer was used to mix the components with each other to yield a mixed powder granule to be pressed.

(2) Pressing

The resultant granule was supplied into a die. A hydraulic press machine was used to subject the granule to pressing at room temperature. The pressure was set to 0.74 GPa. The resultant compact was a toroidal ring having an internal diameter of 7.8 mm, an external diameter of 13.5 mm, and a thickness of 4.3 mm.

(3) Heat Treatment

The resultant compact was annealed in the air atmosphere inside an electrical furnace to yield a magnetic core having the following typical sizes: an internal diameter of 7.7 mm, an external diameter of 13.4 mm, and a thickness of 4.3 mm. In the heat treatment, the temperature of the compact was raised from room temperature to an annealing temperature of 750° C. at a rate of 2° C./minute. At the annealing temperature, the compact was kept for 1 hour, and cooled in the furnace. In order to decompose the binder and other organic substances added at the time of the granulation, a degreasing step of keeping the compact at 450° C. for 1 hour was incorporated into the middle of the heat treatment.

Furthermore, a magnetic core was manufactured, using Fe-based soft magnetic alloy grains made of 4.5% by mass of Cr, 3.5% by mass of Si, and Fe as the balance. The magnetic core was used as Comparative Example 3. Specifically, this magnetic core was yielded by performing the above-mentioned steps (1) to (3) using alloy grains, PF-20F, manufactured by Epson Atmix Corp. However, in the pressing, the pressure was set to 0.91 GPa.

About each of the compacts yielded as described, and the magnetic cores, properties in the following items (A) to (G) were evaluated:

(A) Density dg of Compact, and Density ds Thereof After Annealing

About each of the ring-form compact and the magnetic core, the density (kg/m$^3$) thereof was calculated from the dimensions and the mass thereof by the volume and weight method. The resultant values were defined as the density dg of the compact and the density ds thereof after the annealing, respectively.

(B) Space Factor

The calculated density ds after the annealing was divided by the true density of the soft magnetic alloy to calculate out the space factor (relative density) [%] of the magnetic core. The true density was gained by the volume and weight method applied to an ingot of the soft magnetic alloy that was beforehand yielded by casting.

(C) Magnetic Core Loss Pcv

The ring-form magnetic core was used as a sample to be measured, and a primary side winding line and a secondary side winding line were each wound into 15 turns. A B-H analyzer, SY-8232, manufactured by Iwatsu Test Instruments Corp. was used to measure the magnetic core loss (kW/m$^3$) at room temperature under conditions of a maximum magnetic flux density of 30 mT and frequencies from 50 to 1000 kHz.

(D) Initial Permeability μi

The ring-form magnetic core was used as a sample to be measured, and a conductive line was wound into 30 turns. An LCR meter (4284A, manufactured by Agilent Technologies, Inc.) was used to measure the inductance L at room temperature and a frequency of 100 kHz. The initial permeability μi thereof was gained in accordance with the following equation:

$$\text{Initial permeability } \mu i=(le\times L)/(\mu_0\times Ae\times N^2)$$

wherein le: the magnetic path length (mm), L: the inductance (H) of the sample, $\mu_0$: the magnetic permeability of vacuum=$4\pi\times10^{-7}$ (H/m), Ae: the sectional area (mm$^2$) of the magnetic core, and N: the number of the turns of the coil.

(E) Incremental Permeability $\mu_\Delta$

The ring-form magnetic core was used as a sample to be measured, and a conductive line was wound into 30 turns. The LCR meter (4284A, manufactured by Agilent Technologies, Inc.) was used to measure the inductance L at room temperature and a frequency of 100 kHz in the state of applying a DC magnetic field of 10 kA/m to the coil. In the same way as used to gain the initial permeability μi, the incremental permeability $\mu_\Delta$ was gained.

(F) Radial Crushing Strength σr

The ring-form magnetic core as a sample to be measured was arranged between surface plates of a tension/compression tester (Autograph AG-1, manufactured by Shimadzu Corp.) in accordance with JIS Z 2507. A load was applied to the magnetic core from the radial direction thereof to measure a maximum load P (N) given when the core was broken. The radial crushing strength σr (MPa) thereof was gained in accordance with the following equation:

$$\text{Radial crushing strength } \sigma r \text{ (MPa)} = P(D-d)/(ld^2)$$

wherein D: the external diameter (mm) of the magnetic core, d: the thickness (mm) of the magnetic core [½ of the difference between the internal and external diameters], and 1: the height (mm) of the magnetic core.

(G) Specific Resistance ρ (Electric Resistivity)

A conductive adhesive was applied onto two flat planes of the magnetic core as a sample to be measured, these planes being opposed to each other. After the adhesive was dried and solidified, the magnetic core was set between electrodes. An electric resistance measuring instrument (8340A, manufactured by ADC Corp.) was used to apply a DC voltage of 50 V to the magnetic core to measure the resistance value R (Ω) thereof. The specific resistance ρ (μ~m) of the core was calculated out in accordance with the following equation:

Specific resistance ρ (μ·m)=resistance value R×(Δ/t) wherein A: the area ($m^2$) of any one of the flat planes of the magnetic core [electrode area]; and t: the thickness (m) of the magnetic core [distance between the electrodes].

Figure 4:
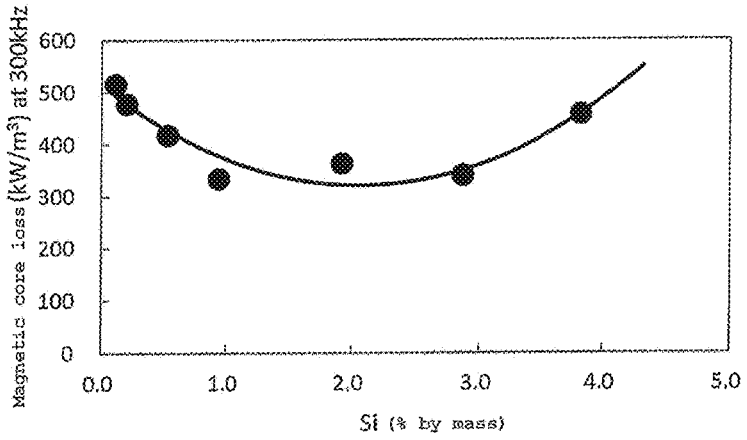
FIG. 4 is a graph showing a relationship between the magnetic core loss of magnetic cores and the Si content by percentage therein.
Figure 5:
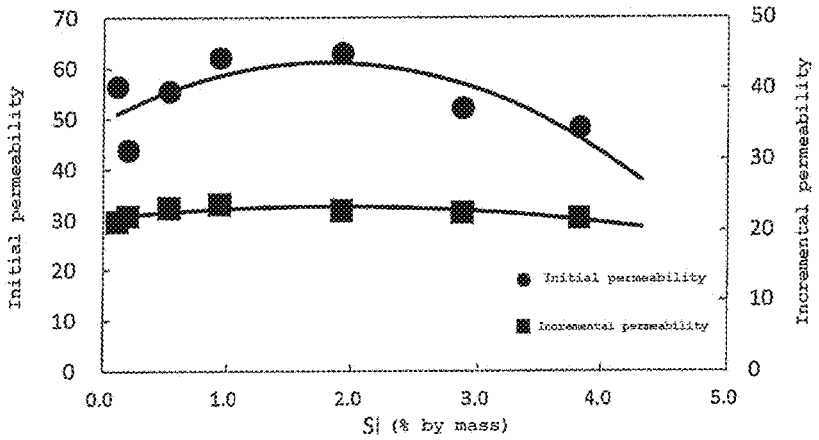
FIG. 5 is a graph showing a relationship between the magnetic permeability of the magnetic cores and the Si content by percentage.

In Table 2 are shown evaluated results of the above-mentioned properties of the magnetic core of each of Comparative Examples 1 to 3, Reference Examples 1 and 2, and Working Examples 1 to 3. In a graph in FIG. 4 is shown a relationship between the magnetic core loss of the magnetic core and the Si content by percentage therein, of each of Comparative Examples 1 and 2, Reference Examples 1 and 2 and Working Examples 1 to 3. In the same manner, in a graph in FIG. 5 is shown a relationship between the Si content by percentage therein, and the initial permeability and the incremental permeability thereof.

meantime, when the Si content was more than 4% by mass, the initial permeability tended to be abruptly decreased. It is therefore understood that it is effective to adjust the Si content to 4% or less by mass. Moreover, even when the Si content exceeded 0.5% by mass, the incremental permeability was not lowered. Thus, it can be stated that in Reference Examples 1 and 2, and Working Examples 1 to 3, DC superimposition characteristics are ensured.

As shown in Table 2, in a range of small Si contents, the specific resistance and the radial crushing strength tend to be lowered with an increase in the proportion of Si. However, in a range of Si contents more than 1% by mass, these properties are hardly lowered. Moreover, such magnetic cores gain a specific resistance of $0.5\times10^3$ Ω·m or more, and a radial crushing strength of 170 MPa or more, which largely exceeds 120 MPa. It can be therefore stated that the magnetic cores are better in specific resistance and strength than conventional magnetic cores (for example, a magnetic core made of Fe—Si—Cr based alloy grains). An increase in the Si content by percentage tends to lower the density of the magnetic core; however, as has been already described, a magnetic core having a Si content of 4% or less by mass has a good magnetic permeability.

Figure 6:
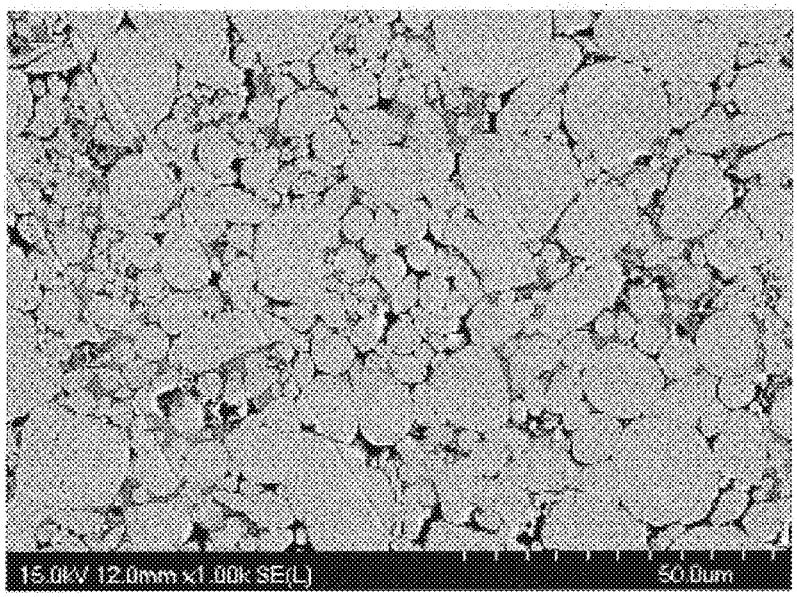
FIG. 6 is an SEM photograph obtained by observing a cross section of a magnetic core of Comparative Example 1.
Figure 7:
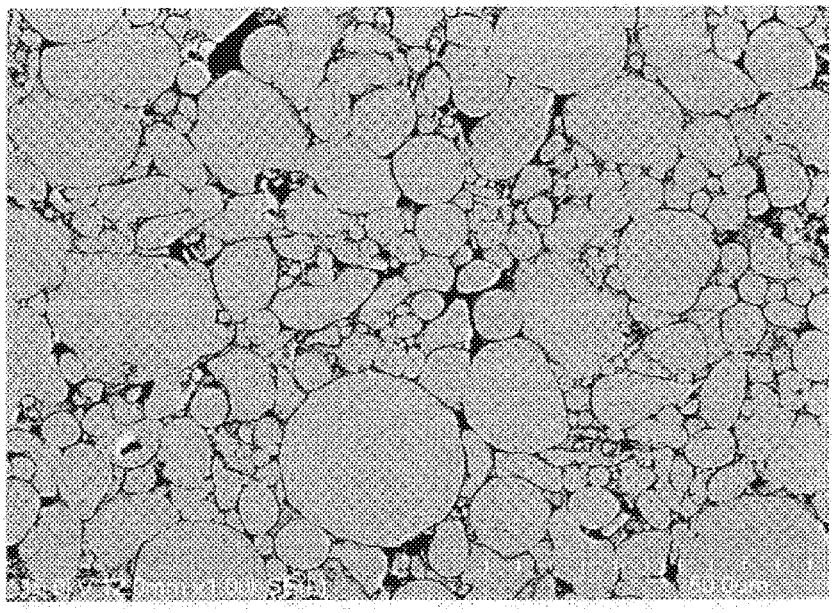
FIG. 7 is an SEM photograph obtained by observing a cross section of a magnetic core of Working Example 3.
Figure 8:
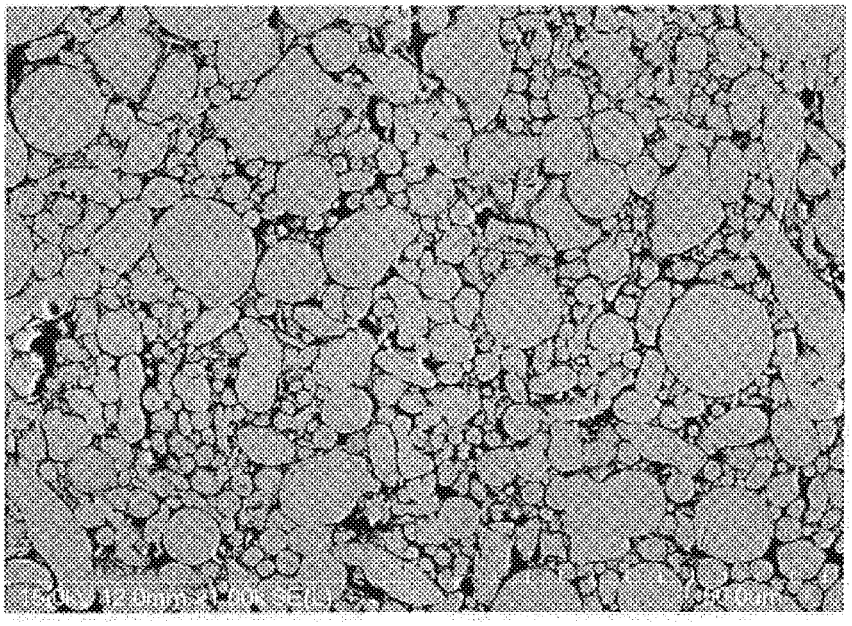
FIG. 8 is an SEM photograph obtained by observing a cross section of a magnetic core of Working Example 4.

About these magnetic cores, a scanning electron microscope (SEM/EDX) was used to observe their cross section. Simultaneously, the distribution of their individual constituting elements was examined. FIGS. 6 to 8 are each an SEM photograph obtained by observing a cross section of the magnetic core of each of Comparative Examples 1 and 2, and Working Examples 1 and 2. Their portions high in brightness are Fe-based soft magnetic alloy grains, and portions low in brightness that are formed on the surface of the grains are grain boundary portions or void portions. It

TABLE 2

| | Alloy grains | Compact density dg ($\times10^3$ kg/$m^3$) | Density ds after annealing ($\times10^3$ kg/$m^3$) | Space factor (%) | Magnetic core loss Pcv (kW/$m^3$) 50 kHz | 100 kHz | 300 kHz | 500 kHz | 1000 kHz | Initial permeability μi | Incremental permeability $\mu_\Delta$ | Radial crushing strength (MPa) | Specific resistance ($\times10^3$ Ω · m) |
|---|---|---|---|---|---|---|---|---|---|---|---|---|---|
| Comparative Example 1 | No. 1 | 6.21 | 6.45 | 88.6 | 76 | 159 | 516 | 913 | 2064 | 56.4 | 21.2 | 244 | 21 |
| Comparative Example 2 | No. 2 | 6.07 | 6.36 | 87.4 | 69 | 149 | 478 | 830 | 1828 | 43.9 | 22.1 | 287 | 12 |
| Reference Example 1 | No. 3 | Not measured | 6.36 | 87.5 | 60 | 135 | 418 | 737 | 1655 | 55.5 | 23.2 | 237 | 6.1 |
| Reference Example 2 | No. 4 | Not measured | 6.30 | 86.6 | 48 | 102 | 334 | 603 | 1406 | 62.2 | 23.7 | 204 | 2.5 |
| Working Example 1 | No. 5 | 5.93 | 6.09 | 85.5 | 51 | 107 | 363 | 666 | 1586 | 63.0 | 22.9 | 172 | 1.7 |
| Working Example 2 | No. 6 | 5.73 | 5.98 | 84.7 | 49 | 104 | 340 | 619 | 1464 | 52.1 | 22.5 | 175 | 1.0 |
| Working Example 3 | No. 7 | 5.65 | 5.90 | 84.7 | 66 | 138 | 457 | 827 | 1932 | 48.2 | 21.8 | 149 | 0.7 |
| Comparative Example 3 | — | Not measured | 6.10 | 82.0 | 82 | — | 536 | 943 | — | 35.0 | 23.3 | 75 | 0.5 |

As shown in FIG. 4, as the Si content by percentage increased, the magnetic core loss was satisfactorily decreased. In particular, in the examples in which the Si content was 0.9% or more by mass, more preferred results were obtained. It is therefore understood that it is effective to adjust the Si content to more than 1% by mass. In each of Reference Example 2 and Working Examples 1 and 2, the magnetic core loss was less than 400 kW/$m^3$ at a frequency of 300 kHz. Moreover, as shown in FIG. 5, the examples in which the Si content was more than 0.9% by mass and 2% or less by mass, the initial permeability was improved. In the can be considered that voids between the alloy grains are increased with an increase of the grains in Si content by percentage, and with this increase, the grains become smaller in density after the annealing.

Figure 9:
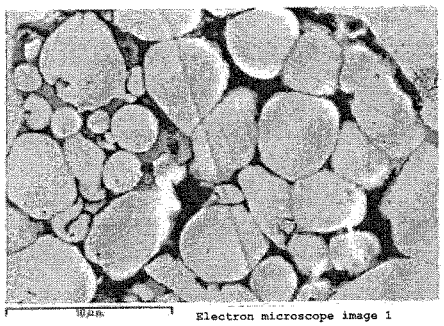
FIGS. 9(*a*) to 9(*f*) are an SEM photograph and mapping diagrams obtained by observing a cross section of a magnetic core of Comparative Example 1.
Figure 9:
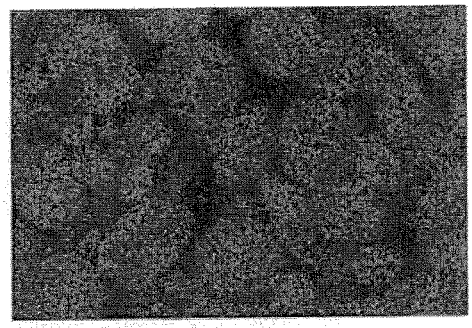
Figure 9:
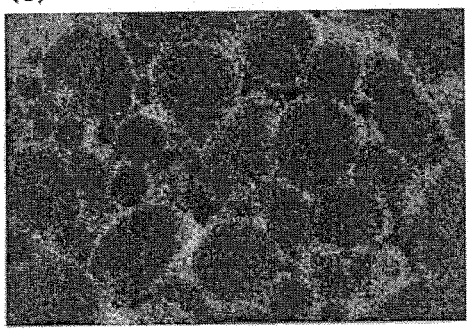
Figure 9:
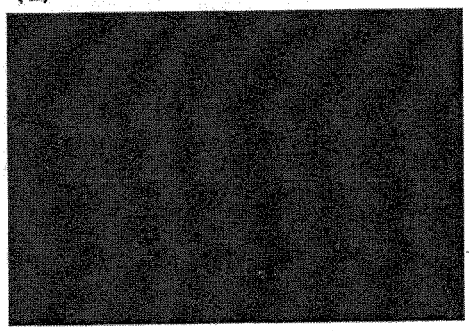
Figure 9:
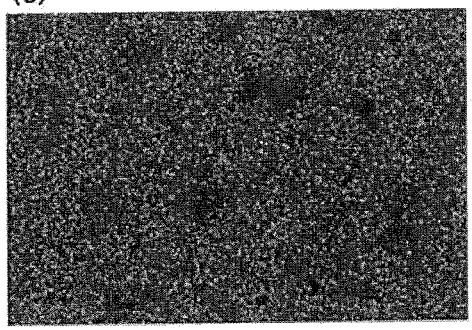
Figure 9:
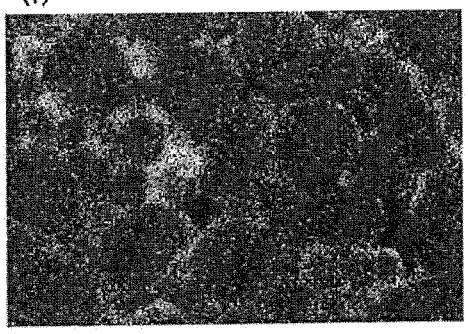
Figure 10:
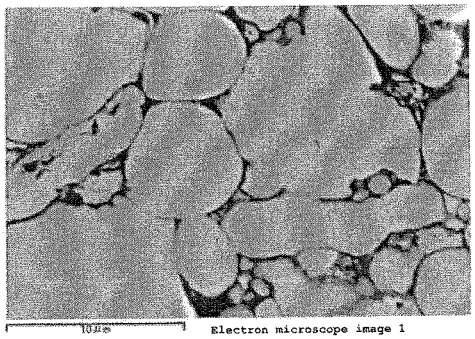
FIGS. 10(*a*) to 10(*f*) are an SEM photograph and mapping diagrams obtained by observing a cross section of a magnetic core of Comparative Example 2.
Figure 10:
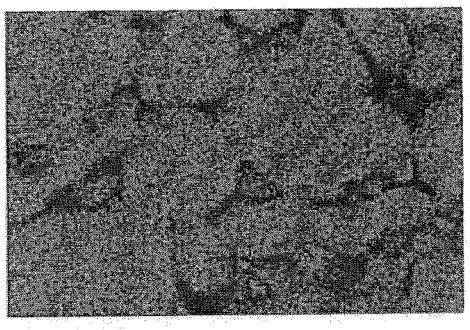
Figure 10:
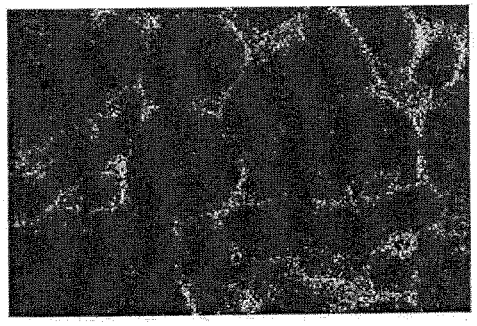
Figure 10:
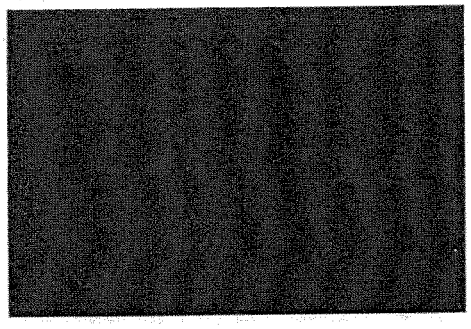
Figure 10:
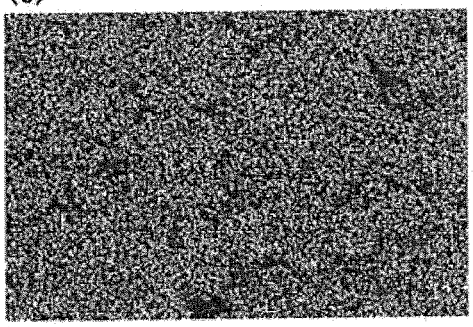
Figure 10:
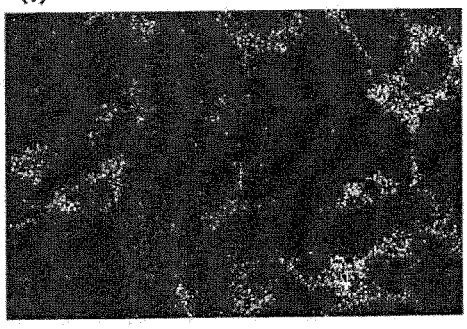
Figure 11:
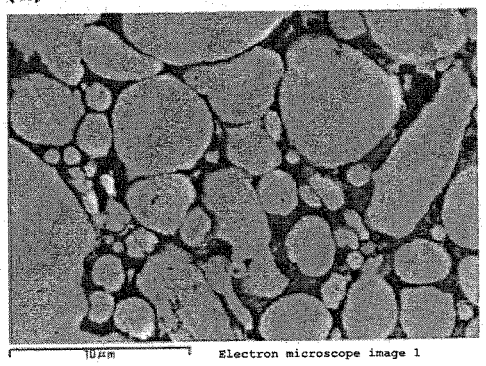
FIGS. 11(*a*) to 11(*f*) are an SEM photograph and mapping diagrams obtained by observing a cross section of a magnetic core of Working Example 1.
Figure 11:
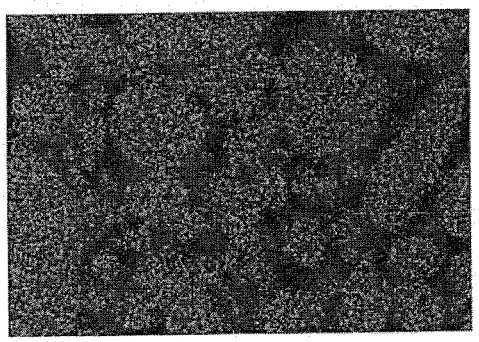
Figure 11:
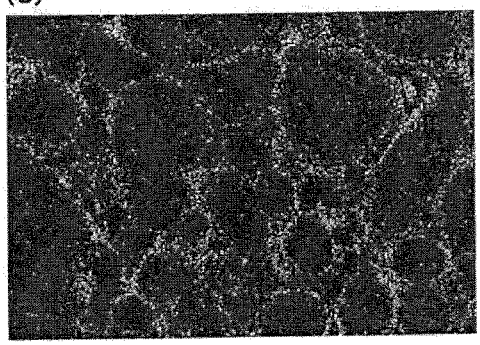
Figure 11:
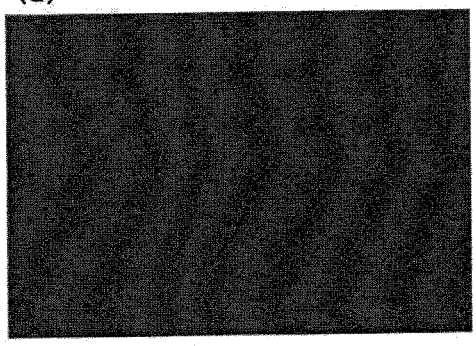
Figure 11:
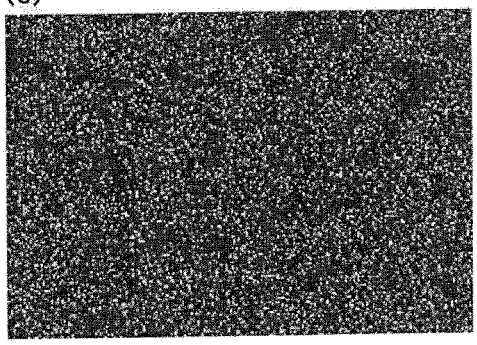
Figure 11:
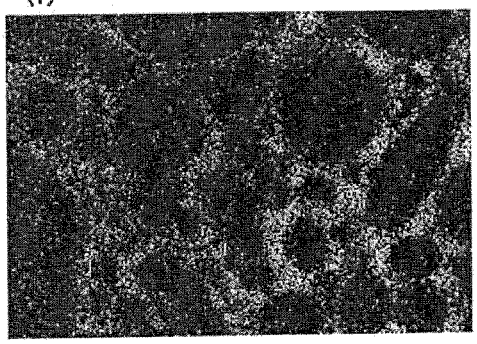
Figure 12:
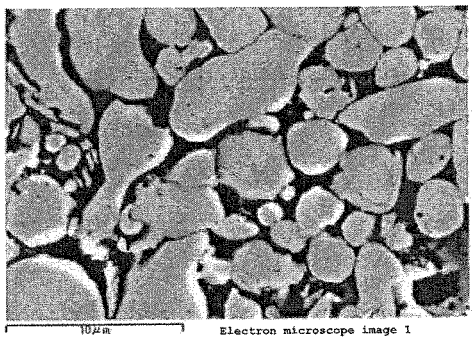
FIGS. 12(*a*) to 12(*f*) are an SEM photograph and mapping diagrams obtained by observing a cross section of a magnetic core of Working Example 2.
Figure 12:
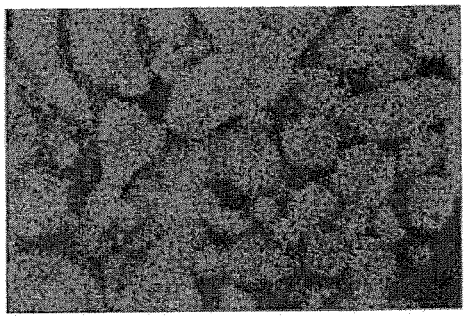
Figure 12:
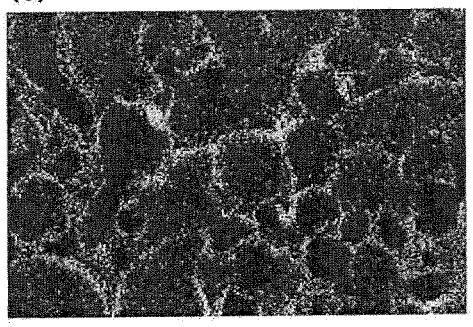
Figure 12:
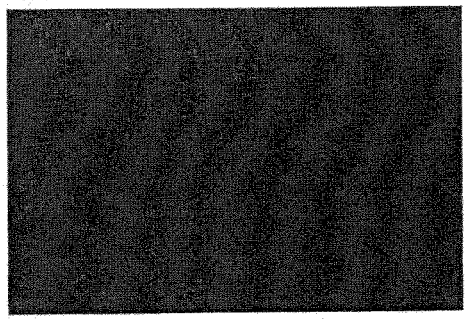
Figure 12:
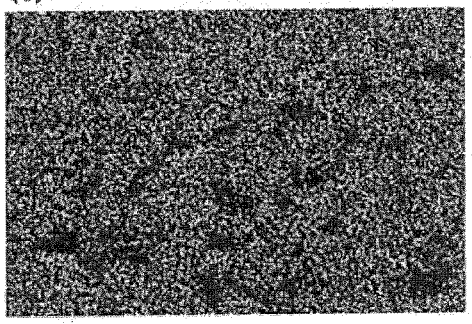
Figure 12:
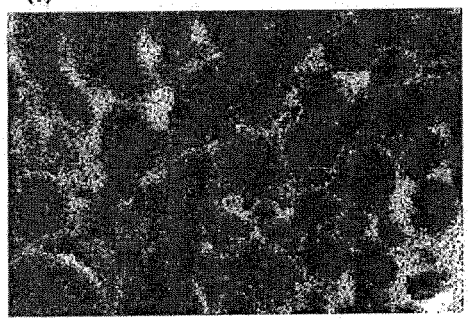
Figure 13:
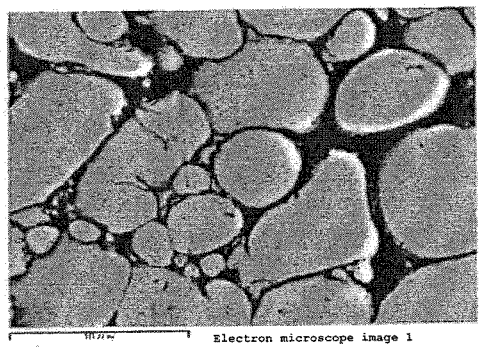
FIGS. 13(*a*) to 13(*f*) are an SEM photograph and mapping diagrams obtained by observing a cross section of a magnetic core of Working Example 3.
Figure 13:
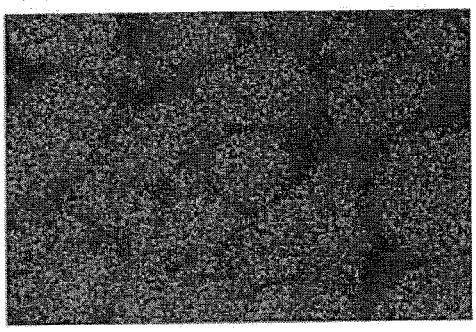
Figure 13:
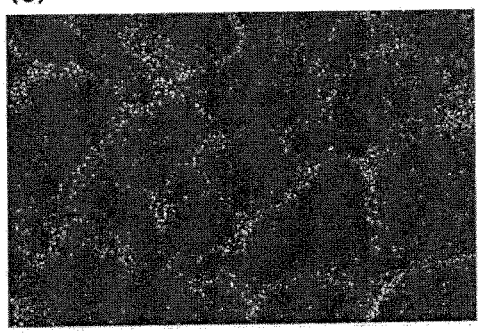
Figure 13:
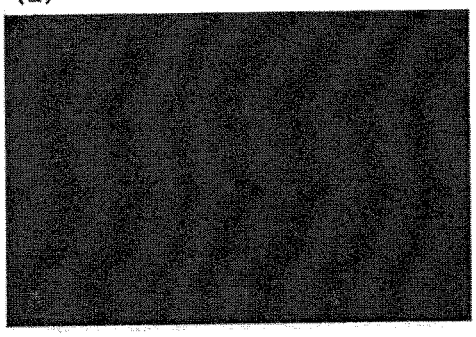
Figure 13:
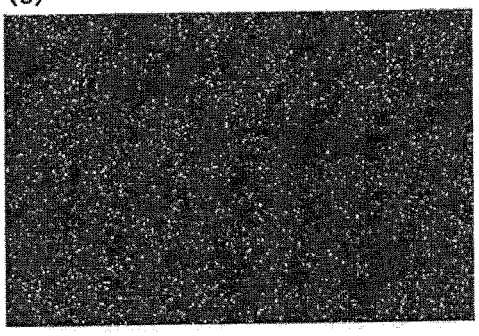
Figure 13:
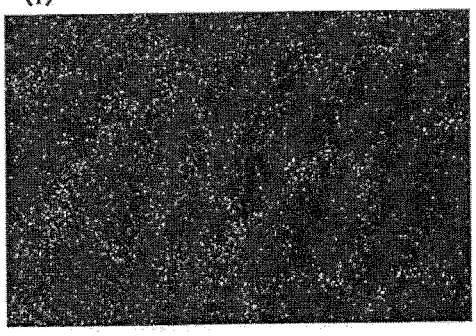
Figure 14:
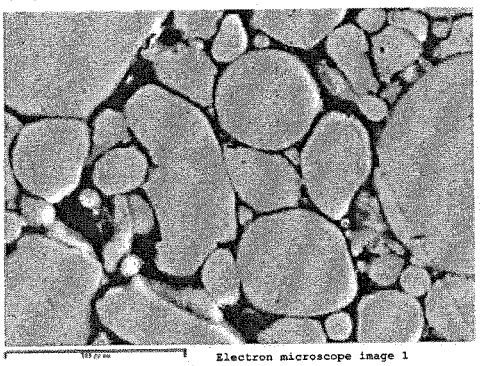
FIGS. 14(*a*) to 14(*f*) are an SEM photograph and mapping diagrams obtained by observing a cross section of a magnetic core of Working Example 4.
Figure 14:
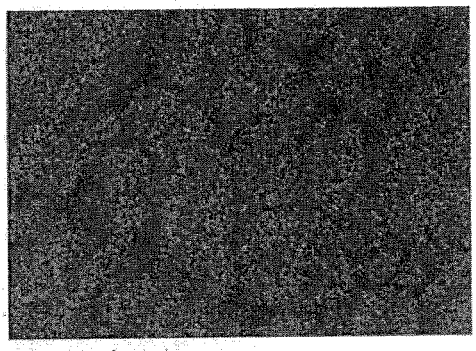
Figure 14:
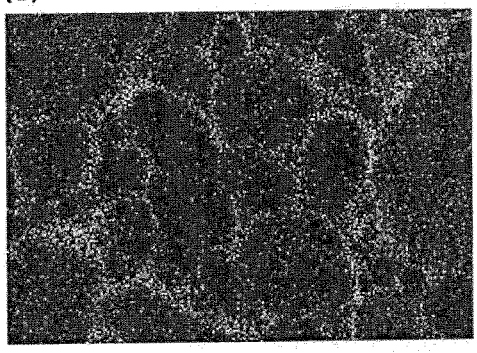
Figure 14:
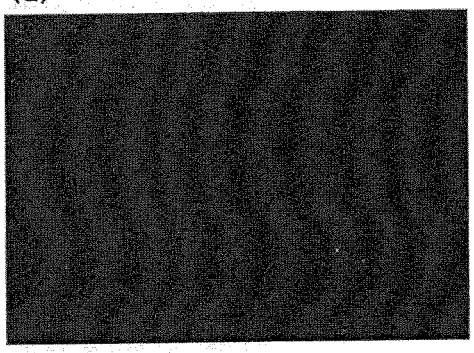
Figure 14:
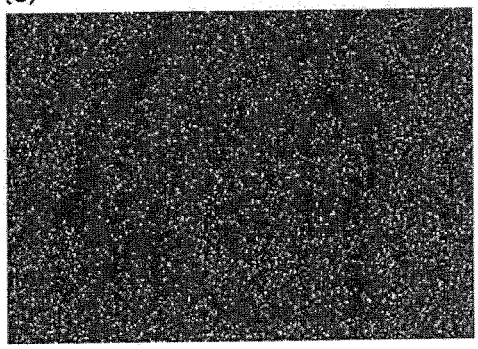
Figure 14:
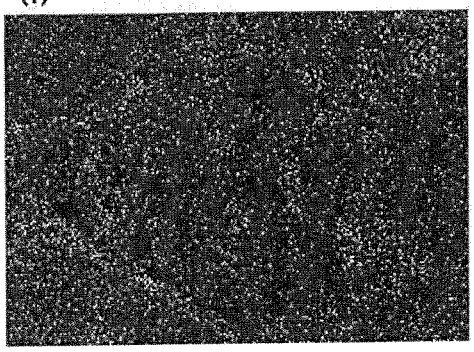

FIGS. 9 are an SEM photograph obtained by observing a cross section of the magnetic core of Comparative Example 1, and mapping views each showing an element distribution in a vision field corresponding thereto; and FIGS. 10 to 14 are the same as about Comparative Example 2, Reference Examples 1 and 2, and Working Examples 1 and 2, respectively. In each of the Working Examples, the following situation is observed: the Al concentration is high in its grain boundary phase; moreover, the proportion of oxygen is large, and thus oxides are produced; and its adjacent alloy phases are bonded to each other through the grain boundary phase. In the grain boundary phase, the Fe concentration is lower as a whole than inside the alloy phases, and Cr and Si do not show a larger concentration distribution than Al.

Figure 15:
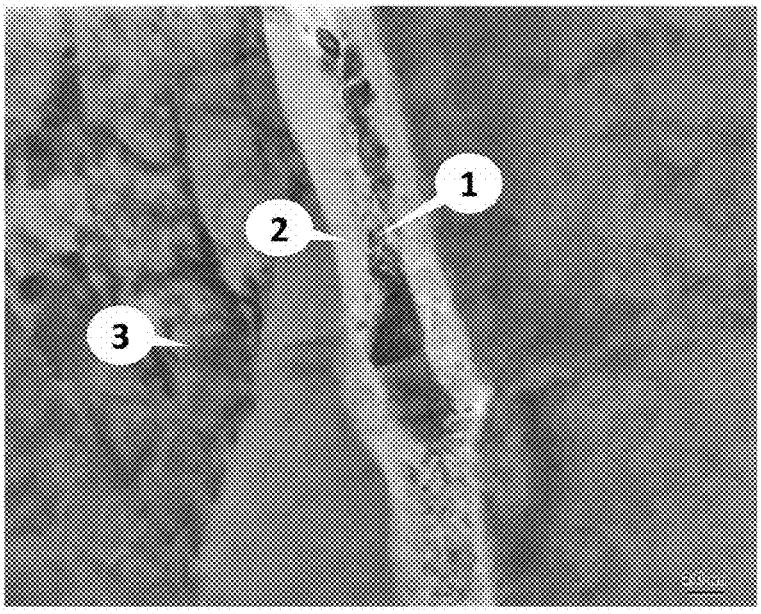
FIG. 15 is an TEM photograph obtained by observing a cross section of a magnetic core of Comparative Example 2.
Figure 16:
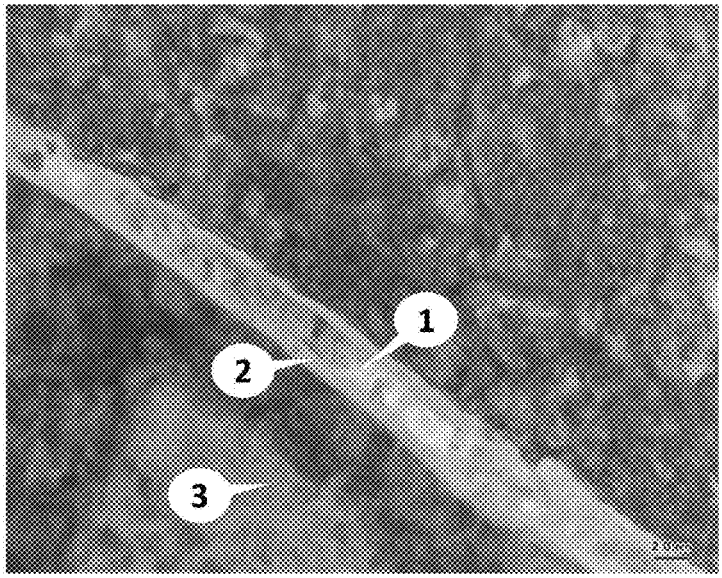
FIG. 16 is an TEM photograph obtained by observing a cross section of a magnetic core of Working Example 2.
Figure 17:
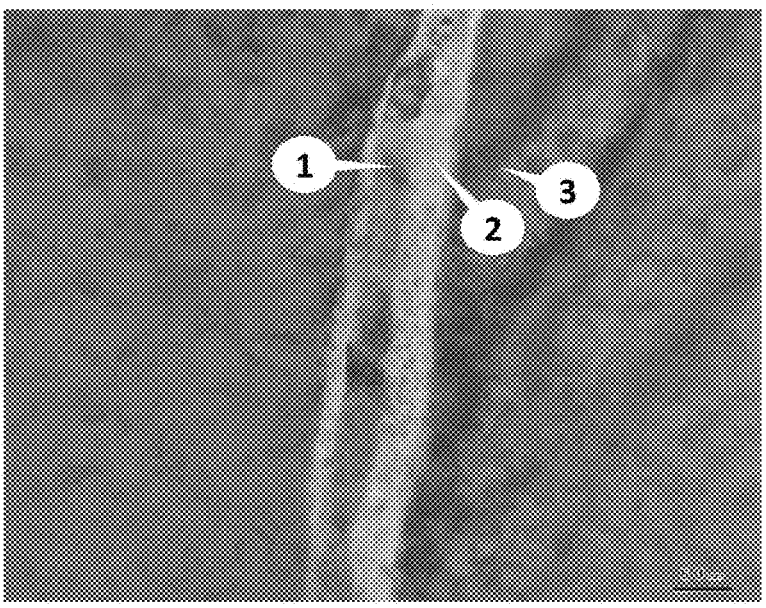
FIG. 17 is an TEM photograph obtained by observing a cross section of a magnetic core of Working Example 4.

FIG. 15 is a TEM photograph obtained by observing a cross section of the magnetic core of Comparative Example 2 at a magnifying power of 600,000 or more through a transmission electron microscope (TEM), and shows a portion where the contour of respective cross sections of two grains in the alloy phases made of Fe-based soft magnetic alloy grains was verified; and FIGS. 16 and 17 are the same as about Reference Example 2 and Working Example 2, respectively. In each of these TEM photographs, a band portion extending in a vertical direction is the grain boundary phase. Portions which are positioned adjacently to each other across the grain boundary phase and are lower in brightness than the grain boundary phase are two of the alloy phases. Portions different from each other in color tone were verified in a central part of the grain boundary phase and in an boundary part of the grain boundary phase that is near the alloy phases.

In the cross section of each of FIGS. 15 to 17, a composition analysis according to TEM-EDX was applied to each of a central part (marker 1) of the grain boundary phase, a boundary part (marker 2) of the grain boundary phase, and an inner part (marker 3) of any one of the alloy phases. The results are shown in Tables 3 to 5. The boundary part of the grain boundary phase was rendered a part which was near the alloy phase and was extended to a position about 5 nm apart from the surface of the alloy grain making its appearance as the contour of the cross section. The inner part of the alloy phase was rendered a part extended to a position about 10 nm or more apart from the surface of the alloy grain. The composition analysis of each of these parts was made in a region having a diameter of 1 nm in the part.

TABLE 3

| | | Marker | Fe | Al | Cr | Si | O |
|---|---|---|---|---|---|---|---|
| | | | | | | (% by mass) | |
| Grain boundary phase | Central part | 1 | 79.1 | 11.8 | 1.8 | 0.1 | 7.2 |
| | Boundary part | 2 | 6.9 | 51.7 | 10.1 | 0.0 | 31.3 |
| Inside of alloy phases | | 3 | 92.6 | 2.9 | 4.2 | 0.3 | 0.0 |

TABLE 4

| | | Marker | Fe | Al | Cr | Si | O |
|---|---|---|---|---|---|---|---|
| | | | | | | (% by mass) | |
| Grain boundary phase | Central part | 1 | 48.1 | 22.5 | 14.4 | 0.5 | 14.5 |
| | Boundary part | 2 | 12.5 | 49.2 | 4.3 | 0.8 | 33.2 |
| Inside of alloy phases | | 3 | 90.8 | 2.8 | 4.4 | 1.0 | 1.0 |

TABLE 5

| | | Marker | Fe | Al | Cr | Si | O |
|---|---|---|---|---|---|---|---|
| | | | | | | (% by mass) | |
| Grain boundary phase | Central part | 1 | 80.6 | 7.1 | 4.0 | 3.3 | 5.0 |
| | Boundary part | 2 | 8.1 | 56.2 | 3.5 | 0.3 | 31.9 |
| Inside of alloy phases | | 3 | 88.1 | 3.8 | 3.9 | 3.1 | 1.1 |

In each of Comparative Example 2, Reference Example 2 and Working Example 2, inside its grain boundary phase, an oxide region was produced which included Fe, Al, Cr and Si and included Al in a larger proportion than its alloy phases. In the grain boundary phase, Zn was also identified, which originated from zinc stearate added as a lubricant. However, Zn is omitted in each of the tables. In the boundary part of the grain boundary phase, the ratio of the quantity of Al to the sum of the quantities of Fe, Al, Cr and Si was higher than that of the quantity of each of Fe, Cr and Si thereto. This region, which was formed at the alloy phase side of the grain boundary phase, corresponds to the first region. In the meantime, in the central part of the grain boundary phase, the ratio of the quantity of Fe to the sum of the quantities of Fe, Al, Cr and Si was higher than that of the quantity of each of Al, Cr and Si thereto. This region corresponds to the second region. In Reference Example 2 and Working Example 2, the Cr concentration was higher in the central part of their grain boundary phase than in the boundary part thereof. In Working Example 2, Si was largely concentrated in the central part of the grain boundary phase than in the boundary part thereof.

As described above, inside the grain boundary phase, it was verified that the oxide region was produced, in which the ratio of the quantity of Al to the sum of the quantities of Fe, Al, Cr and Si was higher than inside the alloy phases. Any oxide of Al is high in insulating property. It is therefore presumed that the production of the Al oxide in the grain boundary phase contributes to ensuring the insulating property and the decrease in the magnetic core loss. It is also considered that as described above, the Fe-based soft magnetic alloy grains are bonded to each other through the grain boundary phase having the first and second regions, and this bonding contributes to ensuring the strength. Furthermore, the magnetic core includes Fe, Al, Cr and Si within the predetermined proportion ranges, respectively. The inclusion can decrease the magnetic core loss.

DESCRIPTION OF REFERENCE SIGNS

1: Magnetic core
20: Fe-based soft magnetic alloy grains
30: Grain boundary phase
30*a*: First region of grain boundary phase
30*b*: Second region of grain boundary phase

The invention claimed is:

1. A magnetic core, having a structure in which alloy phases each including Fe, Al, Cr and Si are dispersed and any adjacent two of the alloy phases are connected to each other through a grain boundary phase, and having a composition which includes Al in a proportion of 3 to 10% both inclusive by mass, Cr in a proportion of 3 to 10% both inclusive by mass, and Si in a proportion more than 1% and 4% or less by mass provided that the sum of the quantities of Fe, Al, Cr and Si is regarded as being 100% by mass, and which includes Fe and inevitable impurities as the balance of the core, wherein the grain boundary phase comprises an oxide region including Fe, Al, Cr and Si, and includes Al in a larger proportion by mass than the alloy phases;

wherein the grain boundary phase has a first region and a second region;

wherein the first region is formed at an alloy-phase-side;

wherein the second region is sandwiched, from both sides thereof, between portions of the first region;

wherein the first region is a region in which the ratio of the quantity of Al to the sum of the quantities of Fe, Al, Cr and Si is higher than that of the quantity of each of Fe, Cr and Si thereto; and wherein the second region is a region in which the ratio of the quantity of Fe to the sum of the quantities of Fe, Al, Cr and Si is higher than that of the quantity of each of Al, Cr and Si thereto.

2. The magnetic core according to claim 1, including Si in a proportion of 3% or less by mass.

3. The magnetic core according to claim 1, having a specific resistance of $0.5 \times 10^3$ Ω·m or more, and a radial crushing strength of 120 MPa or more.

4. A coil component, comprising the magnetic core recited in claim 1, and a coil fitted to the magnetic core.

5. The magnetic core according to claim 1, wherein the total content of Al and Cr is 7% or more, provided that the sum of the quantities of Fe, Al, Cr and Si is regarded as being 100% by mass.

6. A magnetic core manufacturing method, comprising the steps of:

mixing a binder with Fe-based soft magnetic alloy grains which include Al in a proportion of 3 to 10% both inclusive by mass, Cr in a proportion of 3 to 10% both inclusive by mass, and Si in a proportion more than 1% and 4% or less by mass, and which includes Fe and inevitable impurities as the balance of the grains to yield a mixed powder;

subjecting the mixed powder to pressing to yield a compact; and subjecting the compact to heat treatment in an atmosphere including oxygen to yield a magnetic core having a structure in which alloy phases comprising the Fe-based soft magnetic alloy grains are dispersed;

wherein the heat treatment results in: forming a grain boundary phase through which the alloy phases are connected to each other; and further producing, in the grain boundary phase, an oxide region including Fe, Al, Cr and Si and further including Al in a larger proportion by mass than the alloy phases;

wherein the grain boundary phase has a first region and a second region;

wherein the first region is formed at an alloy-phase-side;

wherein the second region is sandwiched, from both sides thereof, between portions of the first region;

wherein the first region is a region in which the ratio of the quantity of Al to the sum of the quantities of Fe, Al, Cr and Si is higher than that of the quantity of each of Fe, Cr and Si thereto; and wherein the second region is a region in which the ratio of the quantity of Fe to the sum of the quantities of Fe, Al, Cr and Si is higher than that of the quantity of each of Al, Cr and Si thereto.

* * * * *